United States Patent [19]

Taguchi

[11] Patent Number: 5,065,589

[45] Date of Patent: Nov. 19, 1991

[54] CONTROL APPARATUS USED FOR A REFRIGERANT CIRCUIT HAVING A COMPRESSOR WITH A VARIABLE DISPLACEMENT MECHANISM

[75] Inventor: Yukihiko Taguchi, Gunma, Japan

[73] Assignee: Sanden Corporation, Isesaki, Japan

[21] Appl. No.: 509,772

[22] Filed: Apr. 17, 1990

[30] Foreign Application Priority Data

Apr. 17, 1989 [JP] Japan ..... 1-95330

[51] Int. Cl.[5] ..... F25B 49/00

[52] U.S. Cl. ..... 62/161; 62/228.5; 62/229; 236/91 F

[58] Field of Search ..... 62/133, 161, 163, 164, 62/227, 228.5, 229; 336/91 R, 91 F, 91 G

[56] References Cited

U.S. PATENT DOCUMENTS

| | | | |
|---|---|---|---|
| 4,102,150 | 7/1978 | Kountz | 62/209 |
| 4,132,086 | 1/1979 | Kountz | 62/209 |
| 4,424,682 | 1/1984 | Miska et al. | 62/133 |
| 4,448,034 | 5/1984 | Shimada et al. | 62/161 |
| 4,476,692 | 10/1984 | Nishi et al. | 62/228.5 |
| 4,687,419 | 8/1987 | Suzuki et al. | 417/222 |
| 4,778,348 | 10/1988 | Kikuchi et al. | 417/222 |
| 4,780,059 | 10/1988 | Taguchi | 417/222 |
| 4,882,909 | 11/1989 | Terauchi | 62/228.5 X |
| 4,909,043 | 3/1990 | Masauji et al. | 62/228.5 X |

FOREIGN PATENT DOCUMENTS

| | | |
|---|---|---|
| 0309242 | 9/1988 | European Pat. Off. . |
| 57-175422 | 10/1982 | Japan . |
| 61-55380 | 3/1986 | Japan . |
| 2153822A | 1/1985 | United Kingdom . |

*Primary Examiner*—Harry B. Tanner

*Attorney, Agent, or Firm*—Banner, Birch, McKie & Beckett

[57] ABSTRACT

An automobile air conditioner system including a refrigerant circuit having a condenser, expansion element, evaporator and wobble plate type compressor with a variable displacement mechanism. Two passages communicate between the crank chamber and the suction chamber in the cylinder block. A bellows is disposed in a first passage and controls the communication between the crank chamber and the suction chamber response to crank chamber pressure. A control valve is disposed in the second passage and controls communication between the crank chamber and the suction chamber in the second passage in response to a signal representing the temperature of the air immediately leaving from the evaporator. An electric clutch is mounted on the compressor in order to intermittently transmit the rotational motion of an automobile engine to the drive shaft of the compressor in response to the signal. The automobile air conditioning system is provided with a demist switch for preventing the reduction of visibility through the windshield of the automobile. The operation of the control valve overrides the operation of the bellows without regard to the temperature signal when the demist switch is turned on.

21 Claims, 11 Drawing Sheets

101
START
HIGH
LOW
N1
N2
501
FIRST SWITCHING DEVICE ON
NO
YES
ON
OFF
T01
T02
SECOND SWITCHING DEVICE ON
NO
502
YES
102
DEMIST SWITCH ON
NO
HIGH
LOW
T3
T4
ON
OFF
YES
HIGH LEVEL OUTPUT FROM 2ND AMP.
NO
401
TIMER ON
NO
YES
103
YES
105
SOLENOID COIL ON
104
SOLENOID COIL OFF
HIGH
LOW
T1
T2
106
HIGH LEVEL OUTPUT FROM 1ST AMP.
NO
YES
108
ELECTROMAGNETIC COIL ON
107
ELECTROMAGNETIC COIL OFF

CONTROL APPARATUS USED FOR A REFRIGERANT CIRCUIT HAVING A COMPRESSOR WITH A VARIABLE DISPLACEMENT MECHANISM

BACKGROUND OF THE INVENTION

1. Field of the Invention

The present invention relates to an improved automobile air conditioning system. More particularly, the present invention relates to a refrigerant circuit having a slant plate type compressor with a variable displacement mechanism suitable for use in an automobile air conditioning system.

2. Description of the Prior Art

One construction of a slant plate type compressor, particularly a wobble plate type compressor, with a variable capacity mechanism which is suitable for use in an automobile air conditioning system is disclosed in U.S. Pat. No. 3,861,829 issued to Roberts et al. The Roberts et al. '829 patent discloses a wobble plate type compressor which has a cam rotor driving device to drive a plurality of pistons. The slant or incline angle of the slant surface of the wobble plate is varied to change the stroke length of the pistons which changes the displacement of the compressor. Changing the incline angle of the wobble plate is effected by changing the pressure difference between the suction chamber and the crank chamber in which the driving device is located.

In the compressor of the '829 patent, the slant angle of the slant surface is controlled by the pressure in the crank chamber. Typically this control occurs in the following manner. The crank chamber communicates with the suction chamber through an aperture and the opening and closing of the aperture is controlled by a valve mechanism. The valve mechanism generally includes a bellows element and a needle valve, and is located in the suction chamber so that the bellows element operates in accordance with changes in the suction chamber pressure. The pressure of the suction chamber is compared with a predetermined value by the valve mechanism. However, when the predetermined value is below a critical value, there is a possibility of frost forming on the evaporator in the refrigerant circuit. Thus, the predetermined value is usually set higher than the critical value to prevent frost from forming on the evaporator.

Since suction pressure above the critical value is higher than the pressure in the suction chamber when the compressor operates at maximum capacity, the cooling characteristics of the compressor are inferior to those of the same compressor without a variable displacement mechanism. As shown in FIG. 1, the temperature of the air leaving the evaporator cannot fall to the temperature of the air leaving the evaporator when the compressor operates at maximum capacity. In FIG. 1, T2 is the temperature corresponding to the critical value, for example, 4 degrees centigrade. T1 is the temperature when the compressor operates at maximum capacity, for example, 2 degrees centigrade. Accordingly, one of the disadvantages of an automobile air conditioning system including the compressor of the '829 patent is that inner surfaces of the automobile windows are not rapidly demisted when required because the cooling characteristics of the compressor are inferior to those of the same compressor without a variable displacement mechanism.

Roberts et al. '829 discloses a capacity adjusting mechanism used in a wobble plate type compressor. As is typical in this type of compressor, the wobble plate is disposed at a slant or incline angle relative to the drive shaft axis. The wobble plate nutates but does not rotate as the drive shaft rotates to drive the pistons. Capacity adjustment is accomplished by using selective fluid communication between the crank chamber and the suction chamber. This type of capacity adjustment can be used in any type of compressor which uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor is used herein to include wobble and swash plate type compressors which use a slanted plate or surface in the drive mechanism.

An improved capacity adjusting mechanism is disclosed in U.S. Pat. No. 4,778,348 issued to Kikuchi et al. In the '348 patent, a single controlled compressor solenoid valve is used in combination with a pressure actuated bellows valve (the first valve control device) to improve cooling characteristics and temperature control in the passenger compartment. During the "cool down" stage of an air conditioning system including such a compressor, when the passenger compartment is initially cooled, the second valve control device connects the crank chamber to the suction chamber due to a heat load on the evaporator of the air conditioning system exceeding a predetermined value. Once the heat load drops to the predetermined value, the second valve control device closes the valve. The valve is only reopened if the heat exceeds that predetermined value which will normally occur after the air conditioning system has been turned off and then restarted after a certain time period. Once the second valve control device closes the second valve, the first valve control device solely controls the capacity of the compressor. That is, after the cool down stage, the compressor operates similar to the compressor of the '829 patent. Therefore, the drawbacks of the '829 patent as described above occur during the operation of the automobile air conditioning system disclosed in the '348 patent.

Furthermore, in general, when an automobile air conditioning system is turned on, an "idle up device" is sequentially turned on. The idle up device is used for increasing the number of rotations of an engine in order to compensate for the decrease in the number of rotations of the engine when the compressor is driven during the idling stage of the engine. However, when the temperature of the air out-side the automobile is low, the compressor operates at a controlled displacement because that the heat load on the evaporator is small. This results in a decrease in the driving power supplied to the compressor by the engine. Therefore, under the above conditions, an unnecessary increase in the number of rotations of the engine occurs during the idling stage of the engine due to the operation of the idle up device thereby causing unnecessary fuel consumption.

SUMMARY OF THE INVENTION

Accordingly, it is an object of the present invention to provide an air conditioning control apparatus which provides demisting capability in an automobile air conditioning system using a compressor with a variable displacement mechanism.

It is another object of the present invention to provide an air conditioning control apparatus which can eliminate unnecessary fuel consumption during operation of an automobile air conditioning system while the automobile engine is idling.

The present invention in directed to an automobile air conditioning system including a refrigerant circuit, formed by a condenser, expansion element, evaporator and compressor. The compressor includes a variable displacement control mechanism, canceling device for cancelling the operation of the variable displacement control mechanism, detecting means for detecting a thermal condition of the evaporator and producing a control signal therefrom, a first control means for controlling the operation of the compressor in response to the control signal received from the detecting device, and a second control means for controlling the operation of the canceling device in response to the control signal received from the detecting device. A selecting device enables either said second control device or said canceling device. The canceling device starts to operate without regard to the control signal when the selecting device enables the operation of the canceling device.

Furthermore, the compressor is driven by an internal combustion engine of an automobile. The canceling device starts to operate without regard to the control signal when (1) the rotation rate of the engine is lower than a predetermined value and (2) the outside temperature is lower than a predetermined value.

DETAILED DESCRIPTION OF THE PREFERRED EMBODIMENTS

Figure 2:
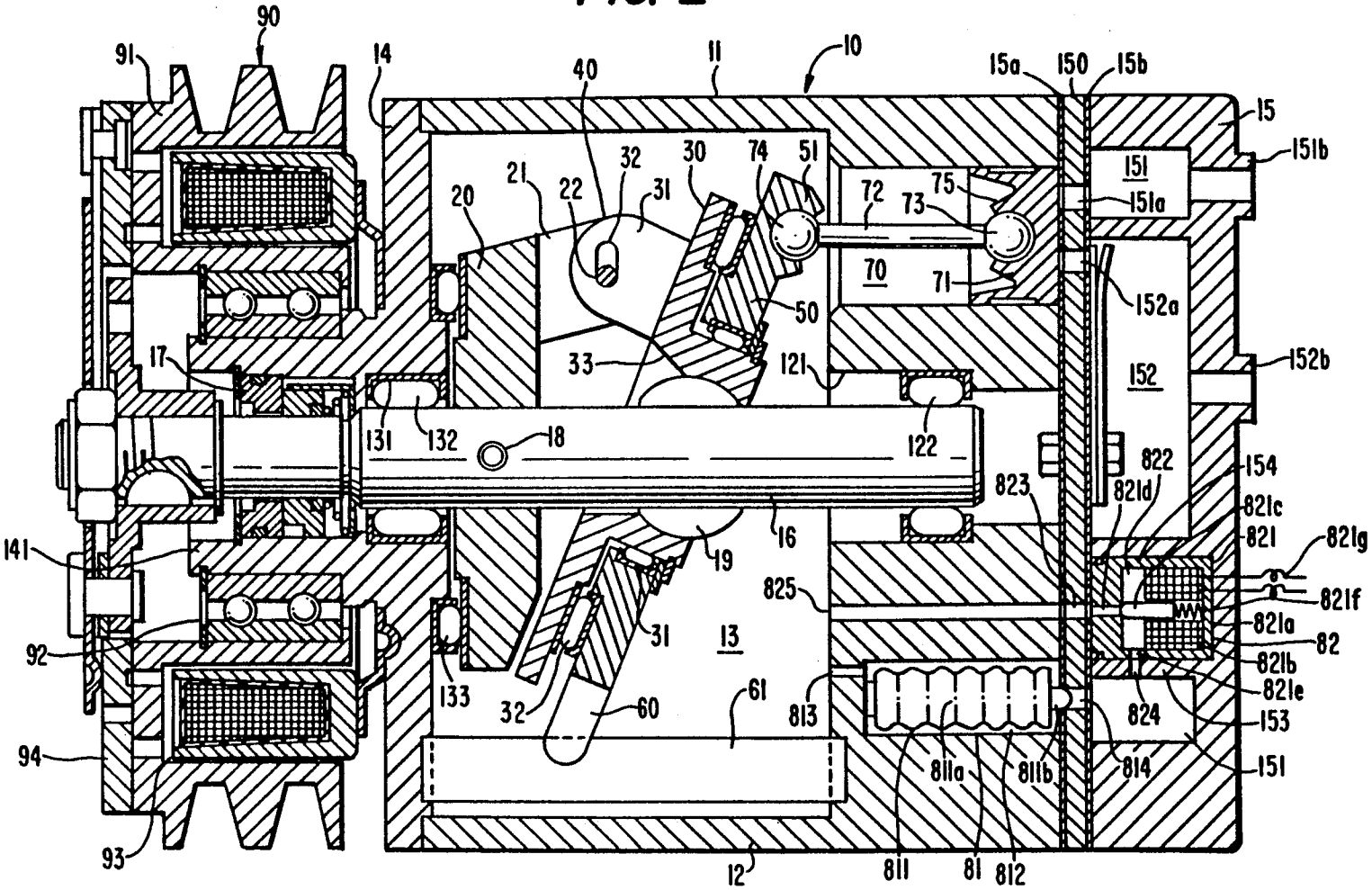
FIG. 2 is a sectional view of a wobble plate compressor with a variable displacement mechanism in accordance with the present invention.

With reference to FIG. 2, a wobble plate type compressor is shown. Compressor 10 includes a closed cylindrical housing assembly 11 formed by a cylinder block 12, crank chamber 13 within cylinder block 12, front plate 14 and rear plate 15.

Front plate 14 is mounted on the left end portion of crank chamber 13, as shown in FIG. 2, by a plurality of bolts (not shown). Rear plate 15 and valve plate 150 are mounted on the cylinder block 12 by a plurality of bolts (not shown). An opening 131 is formed in front plate 14 for receiving drive shaft 16. Drive shaft 16 is rotatably supported by front plate 14 through bearing 132 which is disposed within opening 131. The other end portion of drive shaft 16 is rotatably supported by cylinder block 12 through bearing 122. Central bore 121 provides a cavity in the center portion of cylinder block 12. A thrust needle bearing 133 is disposed between the inner surface of front plate 14 and cam rotor 20. Front plate 14 has an annular sleeve portion 141 projecting from its front end surface. Annular sleeve portion 141 surrounds drive shaft 16 to define a shaft seal cavity. Shaft seal 17 is disposed between an inner surface of annular sleeve portion 141 and the outer surface of drive shaft 16.

Electromagnetic clutch 90 is disposed on annular sleeve portion 141 and connected to an outer end portion of drive shaft 16. Electromagnetic clutch 90 intermittently transmits the rotational motion from the automobile engine to drive shaft 16 of compressor 10. Electromagnetic clutch 90 includes rotor 91 rotatably supported on annular sleeve portion 141 through ball bearing 92. The electromagnetic clutch 90 further includes electromagnetic coil 93 and armature plate 94.

Cam rotor 20 is fixed on drive shaft 16 by pin member 18 which penetrates cam rotor 20 and drive shaft 16. Cam rotor 20 is provided with arm 21 having pin 22. Slant plate 30 has an opening 33 formed at a center portion thereof. Spherical bushing 19, slidably mounted on drive shaft 16, mates with the inner surface of opening 33. Slant plate 30 includes arm 31 having slot 32 into which pin 22 is inserted. Cam rotor 20 and slant plate 30 are joined by hinged joint 40, which includes pin 22 and slot 32. Pin 22 is able to slide within slot 32 so that the angular position of slant plate 30 can be changed.

Wobble plate 50 is rotatably mounted on slant plate 30 through bearings 31 and 32. Rotation of wobble plate 50 is prevented by fork-shaped slider 60. Slider 60 is attached to the end of wobble plate 50 and is slidably mounted on sliding rail 61. Sliding rail 61 is held between front plate 14 and cylinder block 12. In order to slide slider 60 on sliding rail 61, wobble plate 50 wobbles without rotation while cam rotor 20 rotates.

Cylinder block 12 has a plurality of annularly arranged cylinders 70 in which respective pistons 71 slide. All pistons 71 are connected to wobble plate 50 by a corresponding plurality of connecting rods 72. Ball 73 at one and of rod 72 is received in socket 75 of piston 71. Another ball 74 at the other end of rod 72 is received in socket 51 of wobble plate 50. Although only one such ball socket connection is shown in the drawings, there are a plurality of sockets arranged peripherally around wobble plate 50 to receive the balls of various rods 72. Each piston 71 is formed with a socket for receiving a ball of its corresponding rod 72.

Rear plate 15 is shaped to define suction chamber 151 and discharge chamber 152. Valve plate 150 is provided with a plurality of suction ports 151*a* connecting suction chamber 151 to respective cylinders 70. Valve plate 150 is further provided with a plurality of discharge ports 152*a* connecting discharge chamber 152 to respective cylinders 70. Suitable reed valves for suction ports 151*a* and discharge ports 152*a* are described in U.S. Pat. No. 4,011,029 issued to Shimizu. Gasket 15*a* is placed between cylinder block 12 and an inner surface of valve plate 150. Gasket 15*b* is placed between the outer surface of valve plate 150 and rear plate 15. Suction inlet port 151*b* and discharge outlet port 152*b* are formed in rear plate 15 and connected to an external fluid circuit.

A variable displacement actuation mechanism comprises first valve control device 81 and second valve control device 82. The devices actuate the displacement of slant plate 30 with respect to drive shaft 16.

First valve control device 81 includes a bellows valve 811 which is disposed within chamber 812. Chamber 812 is connected to crank chamber 13 through a hole or passage 813 formed in cylinder block 12, and is also connected to suction chamber 151 through a hole or passage 814 formed in valve plate 150. Hole 813, chamber 812 and hole 814 provide fluid communication between crank chamber 13 and suction chamber 151. Bellows valve 811 comprises bellows element 811*a* of which one end is attached to an inner end surface of chamber 812, and needle valve element 811*b* which is attached to the other end of bellows element 811*a* in order to face hole 814. Bellows element 811*a* is axially expanded and contracted in response to crank chamber pressure thereby causing needle valve element 811*b* to close and open hole 814 to keep the crank chamber pressure generally constant. Accordingly, first valve control device 81 controls fluid communication between crank chamber 13 and suction chamber 151 to keep the crank chamber pressure generally constant in response to changes in the crank chamber pressure. When the crank chamber pressure is kept constant, the suction chamber pressure is also kept generally constant.

Second valve control device 82 includes solenoid valve 821 which is disposed within cavity 154 formed in rear plate 15. Solenoid valve 821 comprises casing 821*a* which defines control chamber 822. Control chamber 822 encases solenoid coil 821*b*, which surrounds needle valve element 821*c*. Holes 821*d* and 821*e* are formed in casing 821*a*. Hole 821*d* is formed in the top portion of casing 821*a* and faces later mentioned hole 823. Hole 821*e* is formed in the bottom portion of casing 821*a* and faces hole 824. Hole 824 is formed in a partition wall 153. Needle valve element 821*c* is urged toward hole 821*d* by the restoring force of bias spring 821*f*. Wire 821*g* conducts a control signal generated at a location outside the compressor to solenoid coil 821*b*. Hole 823 is formed in valve plate 150 and connects hole 821*d* and conduit 825 formed in cylinder block 12. Therefore, crank chamber 13 is in fluid communication with control chamber 822 through conduit 825, hole 823 and hole 821*d*. Control chamber 822 communicates with suction chamber 151 through hole 821*e* and 824. When solenoid coil 821*b* is not energized, needle valve element 821*c* closes hole 821*d* by virtue of the restoring force of bias spring 821*f*. Therefore, there is no communication between crank chamber 13 and suction chamber 151. When the external signal energizes solenoid coil 821*b*, needle valve element 821*c* moves right against the restoring force of bias spring 821*f* so that crank chamber 13 is in fluid communication with suction chamber 151 via conduit 825, hole 823, hole 821*d*, control chamber 822, hole 821*e* and hole 824. When fluid communication between crank chamber 13 and suction chamber 151 is established through conduit 825 by the operation of second valve control device 82, the operation of first valve control device 81 is over-ridden. Therefore, pressure in crank chamber 13 is reduced to and then maintained at the pressure in the suction chamber 151. Thus, the maximum angle of inclination of slant plate 30 and wobble plate 50 with respect to the axis of drive shaft 16 is maintained. This results in compressor 10 operating at maximum capacity.

Furthermore, the construction of solenoid valve 821 may be modified in a manner such that the closing of needle valve element 821*c* is retarded by spring 821*f*. Accordingly, the external signal would have to be reversed to appropriately actuate the valve.

Figure 1:
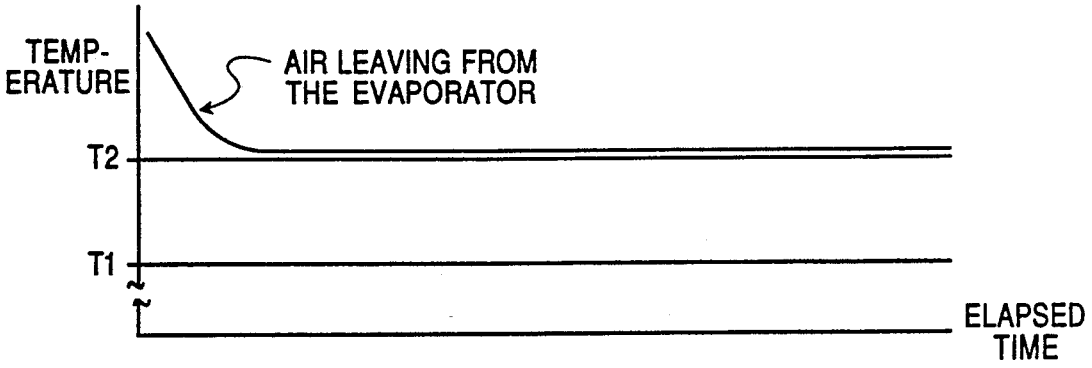
FIG. 1 PRIOR ART
FIG. 1 is a graph of the temperature of the cooled air vs. elapsed time during operation of the automobile air conditioning system of the '829 patent.
Figure 3:
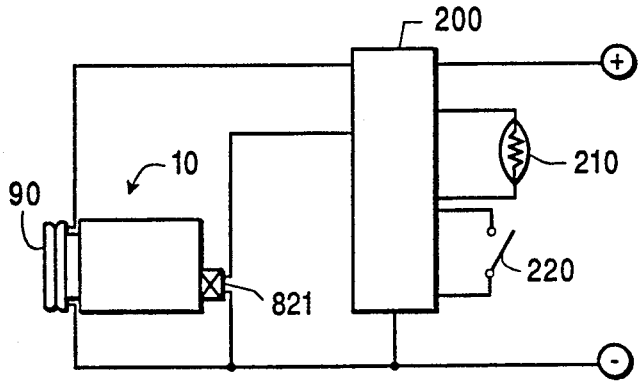
FIG. 3 is a block diagram of a control apparatus according to a first embodiment of the invention.

With reference to FIG. 3, a circuit diagram of control apparatus 200 is shown. Control apparatus 200 includes thermistor 210 and demist switch 220. Thermistor 210 is mounted on the evaporator or in a duct (not shown) in which the air flows from the evaporator into a passenger compartment of an automobile. Thermistor 210 senses temperature of the air leaving the evaporator. The following description will be made as to the case where thermistor 210 is mounted on the evaporator surface. Demist switch 220 is manually turned on in order to energize solenoid coil 821*b* of solenoid valve 821. Control apparatus 200 sends a signal to electromagnetic coil 93 of electromagnetic clutch 90 in response to the operation of demist switch 220 and the temperature of the leaving air sensed by thermistor 210 to control electromagnetic coil 93. Control apparatus 200 also sends a signal to solenoid coil 821*b* in response to the operation of demist switch 220 and the temperature sensed by thermistor 210 to control the operation of solenoid coil 821*b*.

Figure 4:
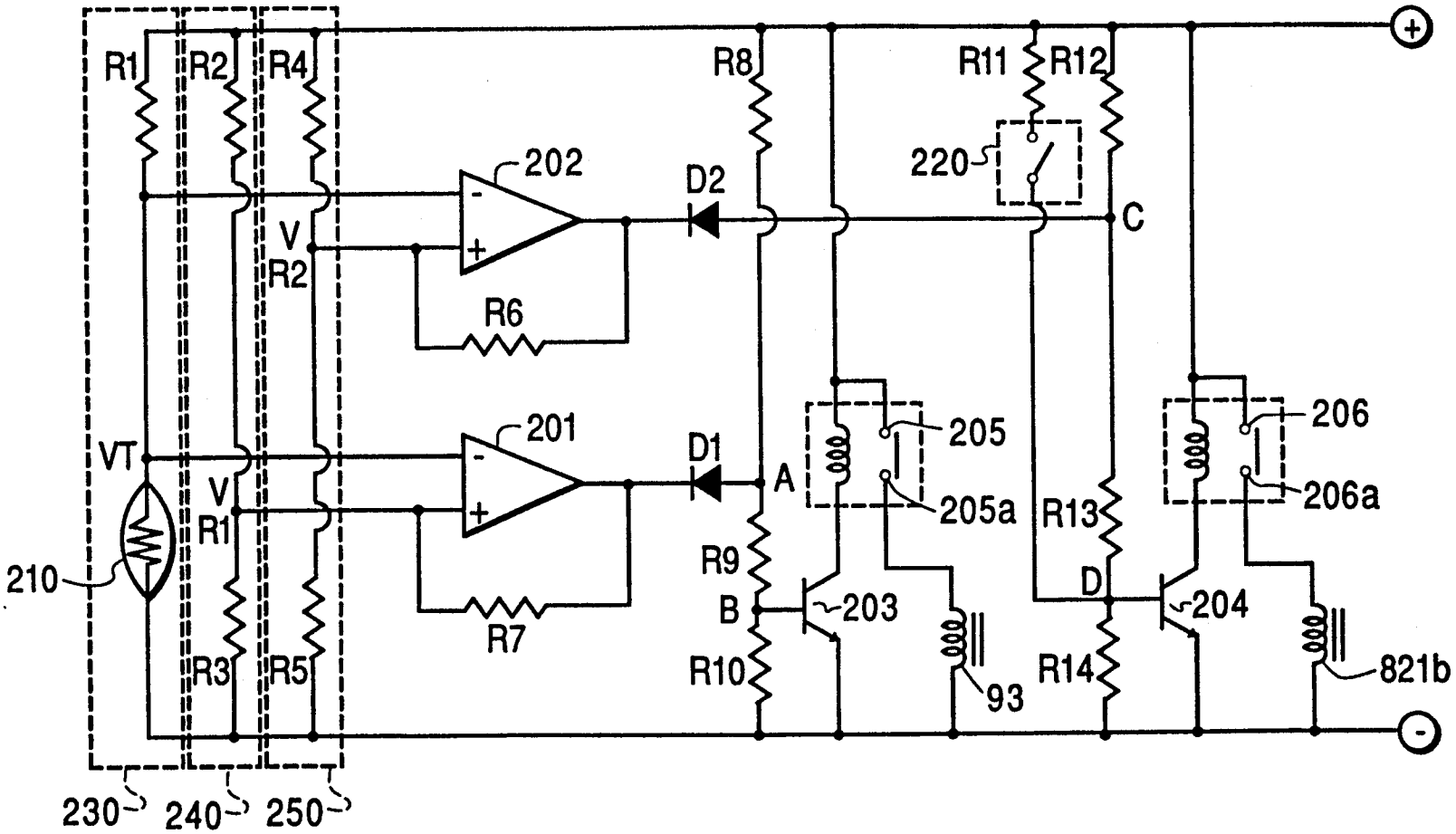
FIG. 4 is a circuit diagram of the control apparatus of FIG. 3.

With reference to FIG. 4, an electric circuit of a first embodiment of the control apparatus 200 is shown. The electric circuit comprises voltage comparator 201, preferably an operational amplifier. Thermistor 210 and resistor R1 from voltage divider 230. The divided voltage Vt is applied to inverting input terminal (−) of comparator 201.

The voltage Vt from voltage divider 230 is a signal representing the temperature of the leaving air. The sensed temperature signal Vt is compared at comparator 201 with a reference voltage VR1 which is generated from voltage divider 240 formed by resistors R2 and R3. Reference voltage VR1 is designated to be equal to temperature signal VT sensed at a time when the leaving air is at a predetermined temperature T1, for example, 2 degrees centigrade. Reference voltage VR1 is applied to a non-inverting input terminal (+) of comparator 201.

When the temperature of the leaving air is higher than the predetermined temperature T1, the output of comparator 201 is high because the reference voltage VR1 is higher than the temperature signal VT. On the other hand, when the temperature of the leaving air is below the predetermined temperature T1, the output of comparator 201 is low because the reference voltage VR1 is lower than the temperature signal VT.

Figure 5:
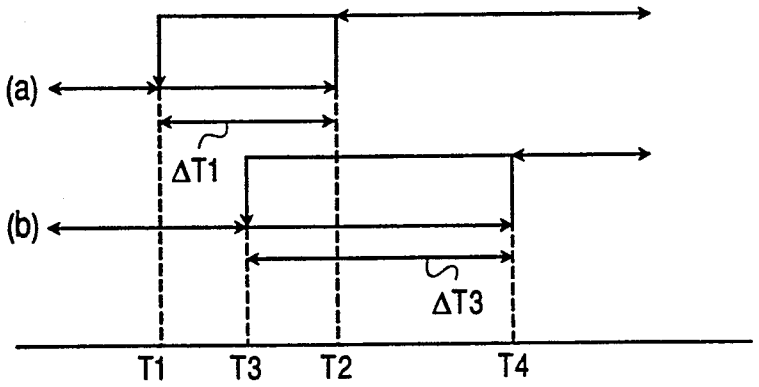
FIGS. 5(*a*) and 5(*b*) are views illustrating the hysteresis effect of each comparator in FIG. 4.

Comparator 201 has feed-back resistor R7 so that the input-output response displays hysteresis. As VT increase from a level lower than reference signal VR1, the output changes from high to low when VT becomes equal to reference signal VR1. However, as VT decrease from a level higher than VR1, the output does not change from low to high until VT becomes lower than VR1 by a certain amount. As a result, the output response of comparator 201 has a hysteresis as shown by FIG. 5(*a*). Temperature difference delta T1 is determined by the resistance of resistor R7. For example, temperature T2 may be 4 degrees centigrade higher than T1.

Another voltage comparator 202 compares temperature signal VT with another reference signal VR2. VR2 is generated by voltage divider 250 comprising resistors R4 and R5. Reference voltage VR2 is designated to be equal to temperature signal VT which will be sensed at a time when the leaving air is at a predetermined temperature T3, for example, 3 degrees centigrade. Temperature T3 is chosen to be higher than temperature T1.

The output of comparator 202 is high when the temperature of the leaving air is higher than the predetermined temperature T3. It is low when the temperature of the leaving air is lower than predetermined temperature T3.

Comparator 202 has feedback resistor R6 to provide a hysteresis. Therefore, the output of comparator 202 changes from low to high at an elevated temperature T4. The output response of comparator 202 to the temperature is as shown by FIG. 5(*b*).

Transistor 203 forms a switching circuit. Resistors R8, R9 and R10 are bias resistors. Relay 205 is connected to the collector of transistor 203, and its operating contact 205*a* is connected in series with electromagnetic coil 93 of electromagnetic clutch 90. The base of transistor 203 is connected to connection point "B" between resistors R9 and R10. When transistor 203 is conductive, relay 205 is enabled, and electromagnet coil 93 is energized.

The output of comparator 201 is connected to connection point "A" between resistors R8 and R9 through diode D1. Therefore, when the output of comparator 201 is low, connection point "A" is also low. Thus, transistor 203 is switched off, and relay 205 is not energized. Therefore, its contact 205*a* is open, so that electromagnet coil 93 is not energized.

Transistor 204 forms a switching circuit. Resistor R12, R13 and R14 are bias resistors. Relay 206 is connected to the collector of transistor 204, and its operating contact 206*a* is connected to solenoid coil 821*b* of solenoid valve 821. The base of transistor 204 is connected to connection point "D" between resistors R13 and R14. When transistor 204 is conductive, relay 206 is enabled, and solenoid coil 821*b* of solenoid valve 821 is energized.

The output of comparator 202 is connected to connection point "C" between resistors R12 and R13 through diode D2. Therefore, when the output of comparator 202 is low, connection point "C" is also low so that transistor 204 is switched off. Therefore, relay 206 is not energized, and its contact 206*a* is open. Thus, solenoid coil 821*b* is not energized.

One contact of demist switch 220 is connected to the positive terminal (+) of the power supply through resistor R11. Another contact of demist switch 220 is connected to connection point "D".When demist switch 220 is turned off, solenoid coil 821*b* is intermittently energized in response to the output of comparator 202. On the other hand, when demist switch 220 is turned on, solenoid coil 821*b* is energized without regard to the state of comparator 202.

Figure 6:
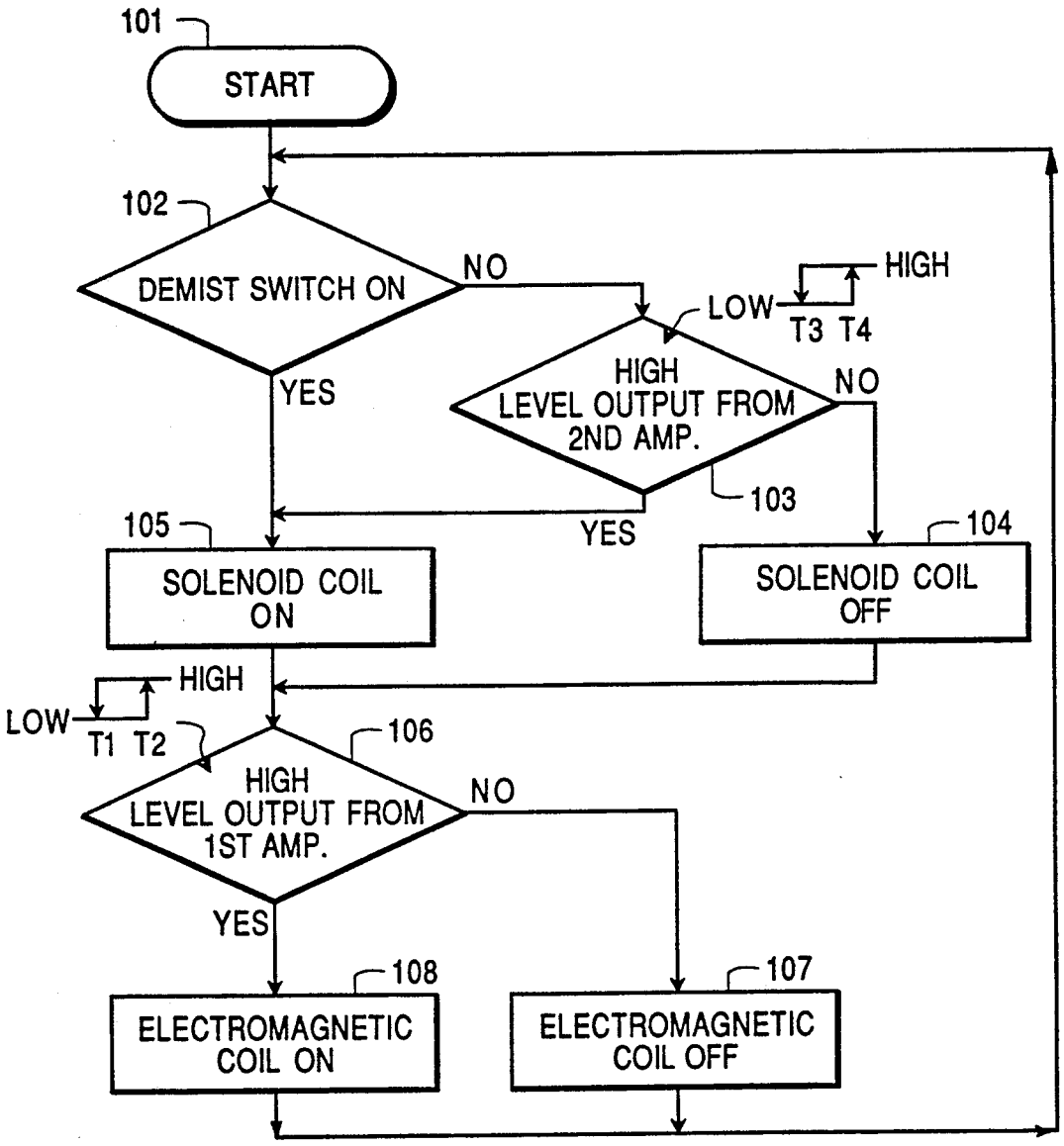
FIG. 6 is a flow chart illustrating the operation of the compressor according to the first embodiment of the invention.

FIGS. 6 shows a flow chart which illustrates the operation of the first embodiment of control apparatus 200. After the automobile air conditioning switch is turned on at step 101, the state of demist switch 220 is judged at step 102. In step 102, when the visibility through the windows of the automobile is poor due to mist, demist switch 220 is manually turned on. On the other hand, when the visibility is good, demist switch 220 is not turned on. When demist switch 220 is not turned on, the sensed temperature signal VT representing the temperature of the leaving air is compared at comparator 202 with reference voltage VR2 at step 103.

In step 103, the output of the second comparator is judged. This comparator behaves as follows: When temperature signal VT is increasing from a level lower than reference signal VR2, the output changes from high to low at a time when temperature signal VT becomes equal to reference signal VR2. That is, when the temperature of the air is dropping from a higher temperature than temperature T4, the output changes from high to low at a time when temperature becomes equal to temperature T3 as shown by FIG. 5(*b*). At this point, relay 206 is de-energized and, therefore, its contact 206*a* in open, so that solenoid coil 821*b* is de-energized as shown by step 104. Accordingly, needle valve element 821*c* closes hole 821*d* by virtue of the restoring force of bias spring 821*f* so that the communication between crank chamber 13 and suction chamber 151 is blocked. Thereby, the displacement of compresssor 10 is controlled by only first valve control device 81 in response to changes in the crank chamber pressure as already described above. When temperature signal VT is decreasing from a higher level than reference signal VR2, the output does not change from low to high until temperature signal VT becomes lower than reference signal VR2 by the certain amount. That is, when temperature of the air is rising from a lower value than temperature T3, the output changes from low to high at a time when temperature becomes equal to temperature T4 as shown by FIG. 5(*b*). At this point, relay 206 is energized and, therefore, its contact 206*a* is closed, so that solenoid coil 821*b* is enerigized as shown by step 105. Accordingly, needle valve element 821*c* moves right against the restoring force of bias spring 821*f* so as to open hole 821*d*. Thereby, compressor 10 is maintained at maximum displacement as already described above.

On the other hand, when demist switch 220 is turned on, solenoid coil 821*b* is energized without regard to the temperature of the leaving air as shown by step 105.

Each of steps 104 and 105 goes to step 106 in which the sensed temperature signal VT representing temperature of the leaving air is compared at comparator 201 with reference voltage VR1. In step 106, the output of the first comparator is judged. The comparator behaves as follows: When temperature signal VT is increasing from a level lower than reference signal VR1, the output changes from high to low at a time when temperature signal VT becomes equal to reference signal VR1. That is, when the temperature is dropping from a higher value than temperature T2, the output changes from high to low when the temperature becomes equal to temperature T1 as shown by FIG. 5(*a*). At this point, relay 205 is de-energized and, therefore, its contact 205*a* is open, so that electromagnetic coil 93 is de-energized as shown by step 107. Accordingly, transmission of the rotational motion from the automobile engine to drive shaft 16 of compressor 10 is interrupted, which interrupts the operation of compressor 10. When temperature signal VT is decreasing from a higher level than reference signal VR1, the output does not change from low to high until temperature signal VT becomes lower than reference signal VR1 by the certain amount. That is, when temperature is rising from a lower value than temperature T1, the output changes from low to high when temperature of the air becomes equal to temperature T2 as shown by FIG. 5(*b*). At that point, relay 205 is energized and, therefore, its contact 205*a* is closed. Thus, electromagnetic coil 93 is energized as shown by step 108. Accordingly, the rotational motion of the automobile engine is transmitted to drive shaft 16 of compressor 10 in order to operate compressor 10. Each of steps 107 and 108 returns to step 102.

Figure 7:
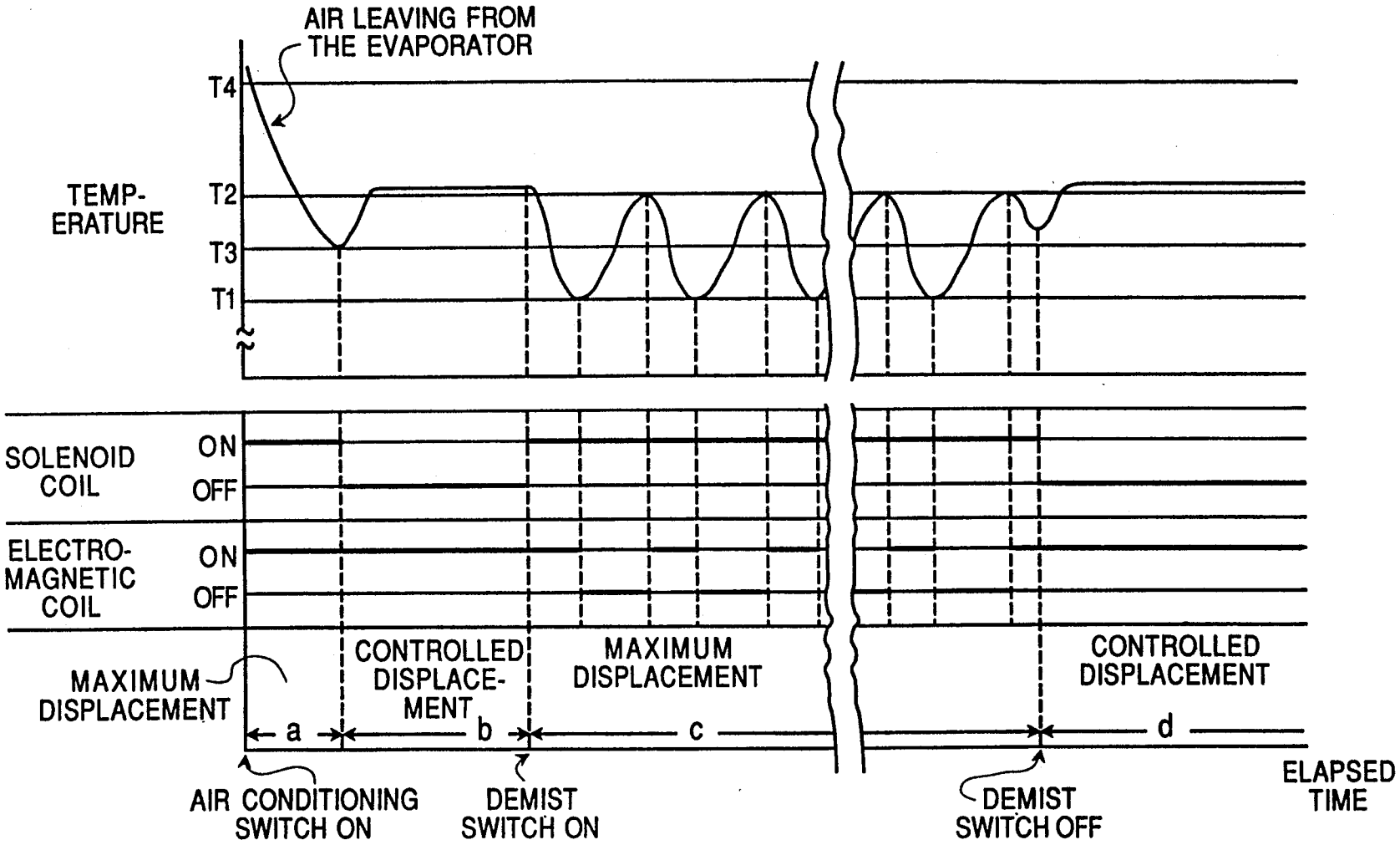
FIG. 7 is a graph of air temperature vs. elapsed time in an automobile air conditioning system according to the first embodiment of the invention.

The first embodiment of control apparatus 200 controls the temperature of the leaving air as shown in FIG. 7. When the automobile air conditioning switch is turned on without turning on demist switch 220, and the temperature of the leaving air is higher than T4, the change in temperature of the leaving air is illustrated by time period "a". In time period "a", compressor 10 continuously operates with the maximum displacement. When the temperature of the leaving air falls to T3, time period "a" is terminated, and time period "b" begins. In time period "b", compressor 10 starts to operate with controlled displacement by operation of only first valve control device 81 in order to maintain the temperature of the leaving air constant, for example, immediately above T2. In this period, when the visibility through the windows of the automobile becomes poor, demist switch 220 is manually turned on, and time period "b" is simultaneously terminated, and time period "c" begins. In time period "c", compressor 10 operates with maximum displacement again, but intermittently by virtue of the intermittent operation of electromagnetic clutch 90. Thereby, the temperature of the leaving air is cyclically controlled from T2 to T1 in order to recover the good visibility through the windows of the automobile. When good visibility through the windows of the automobile is recovered, demist switch 220 is turned off, and time period "c" is simultaneously terminated. After time period "c", the change in temperature of the leaving air is illustrated by time period "d". In time period "d", compressor 10 operates with the controlled displacement again, the same as in time period "b".

In the later-mentioned second and third embodiments of control apparatus 200, the same numerals are used to denote the corresponding elements shown in FIGS. 2–7 so that the substantial explanation thereof is omitted.

Figure 8:
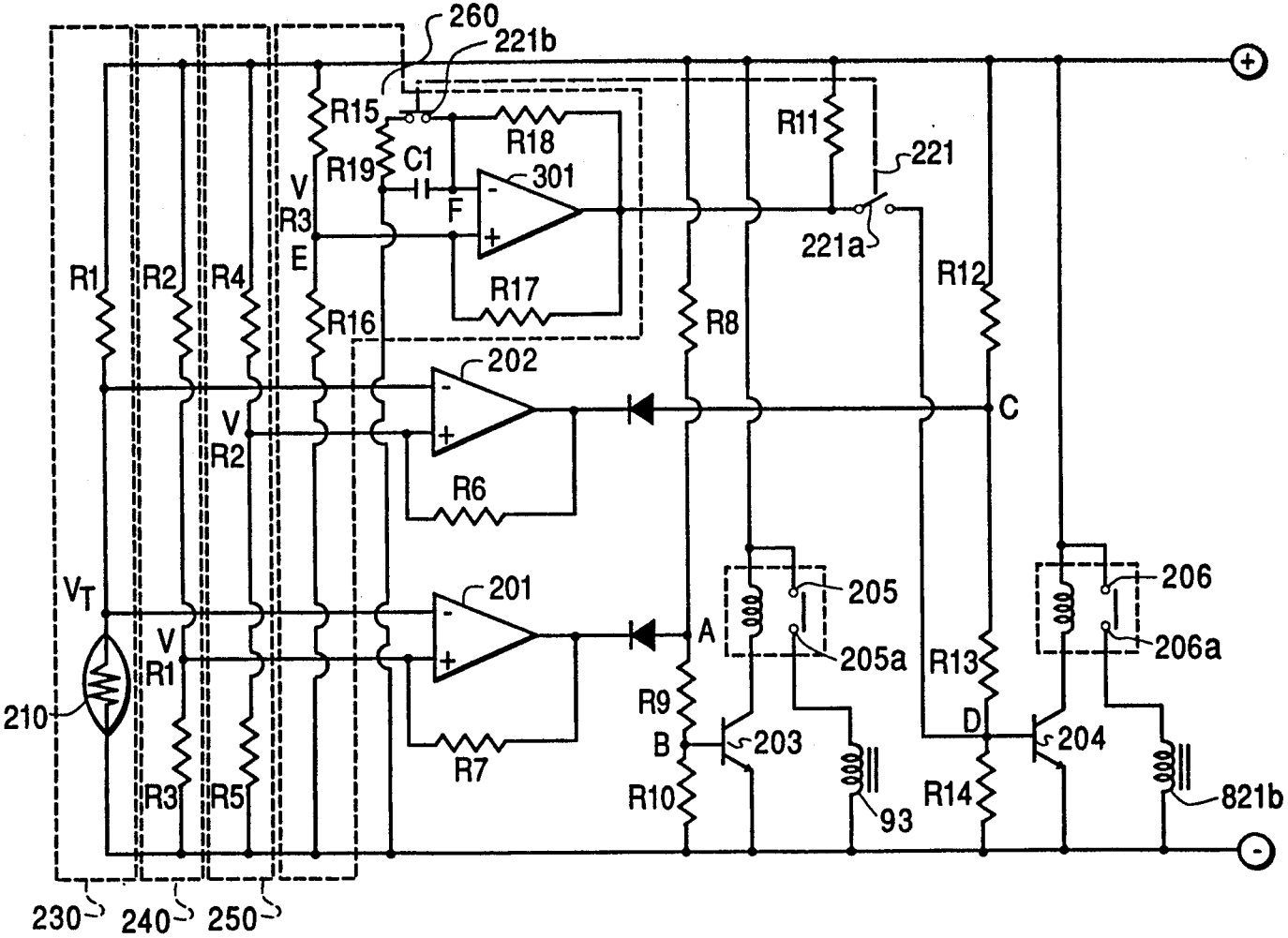
FIG. 8 is a circuit diagram of a second embodiment of the invention.

FIG. 8 illustrates a circuit diagram of a second embodiment of control apparatus 200. As depicted in FIG. 8, the circuit of the second embodiment of control apparatus 200 is formed by adding timer circuit 260, which includes comparator 301 as a third operational amplifier, to the circuit of the first embodiment of control apparatus 200. It also includes replacing demist switch 220 with demist switch 221 having contacts 221*a*and 221*b*. Comparator 301 compares reference voltage VR3 at point "E" determined by resistors R15 and R16 with the voltage at point "F", which is determined by the charging-discharging condition of capacitor C1. Comparator 301 has feed-back resistor R17 so that the input-output response has a hysteresis. When charging capacitor C1 from a level lower than reference signal VR3, the output changes from high to low when the voltage at point "F" becomes equal to reference signal VR3. However, when discharging capacitor C1 from a level higher than reference signal VR3, the output does not change from low to high until the voltage at point "F" becomes lower than reference signal VR3 by a certain amount. As a result, the output response of comparator 301 to the voltage at point "F" has a hysteresis. The above-mentioned certain amount is determined by the resistance of resistor R17.

Figure 9A:
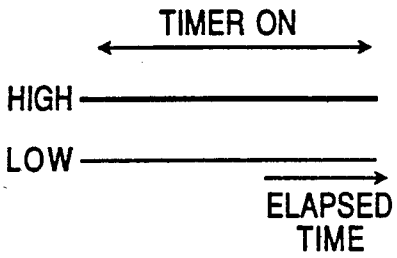
FIGS. 9*a* and 9*b* are graphs of the output of the third operational amplifier shown in FIG. 8.
Figure 9B:
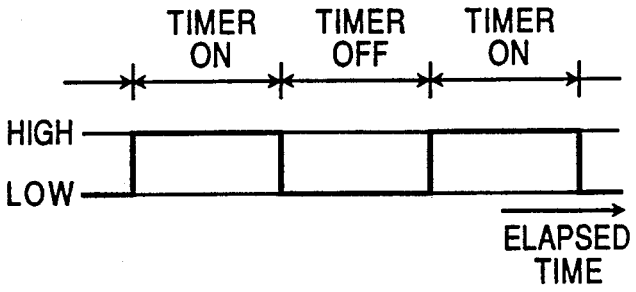

When contact 221*b* of demist switch 221 in closed, the charging of capacitor C1 is determined by resistors R18 and R19. Resistors R18 and R19 are chosen such that the voltage at point "F" is lower than reference signal VR3. Thus, the output of comparator 301 is maintained high as shown by FIG. 9(*a*). When contact 221*b* of demist switch 221 is closed, contact 221*a* in consequently open. Therefore, solenoid coil 821*b* is intermittently energized in response to the output of comparator 202.

On the other hand, when contact 221*a* of demist switch 221 is closed, solenoid coil 821*b* is maintained the energized condition, and contact 221*b* of demist switch 221 is consequentially open. Therefore, capacitor C1 begins to charge. When the voltage at point "F" rises to reference signal VR3, the output of comparator 301 changes from high to low. Thereby, solenoid coil 821*b* is deenergized. Simultaneously, capacitor C1 begins to discharge. When the voltage at point "F" falls to a voltage which is lower than reference signal VR3 by the certain amount, the output of comparator 301 changes from low to high. Thereby, solenoid coil 821*b* is energized again. Simultaneously, capacitor C1 begins to be charged by the voltage of the output of comparator 301. Thus, a cyclic operation results until contact 221*a* of demist switch is opened. This cyclic operation is shown in FIG. 9(*b*).

Figure 10:
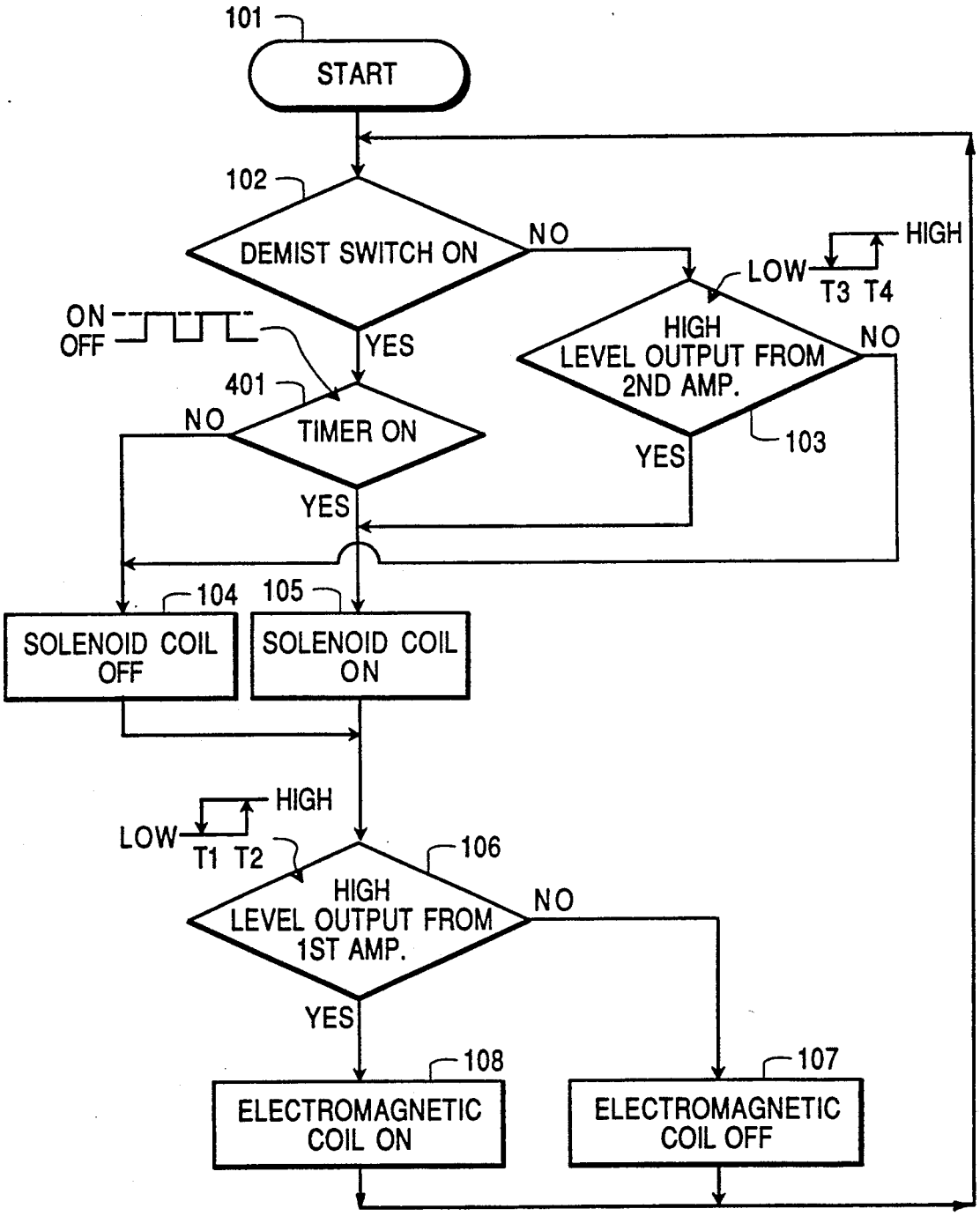
FIG. 10 is a flow chart illustrating the operation of the compressor according to the second embodiment of the invention.

FIG. 10 shows a flow chart of the second embodiment of control apparatus 200. The flow chart of the first embodiment, as shown in FIG. 6, can be changed to the flow chart of the second embodiment by adding step 401 after "yes" of step 102.

Figure 11:
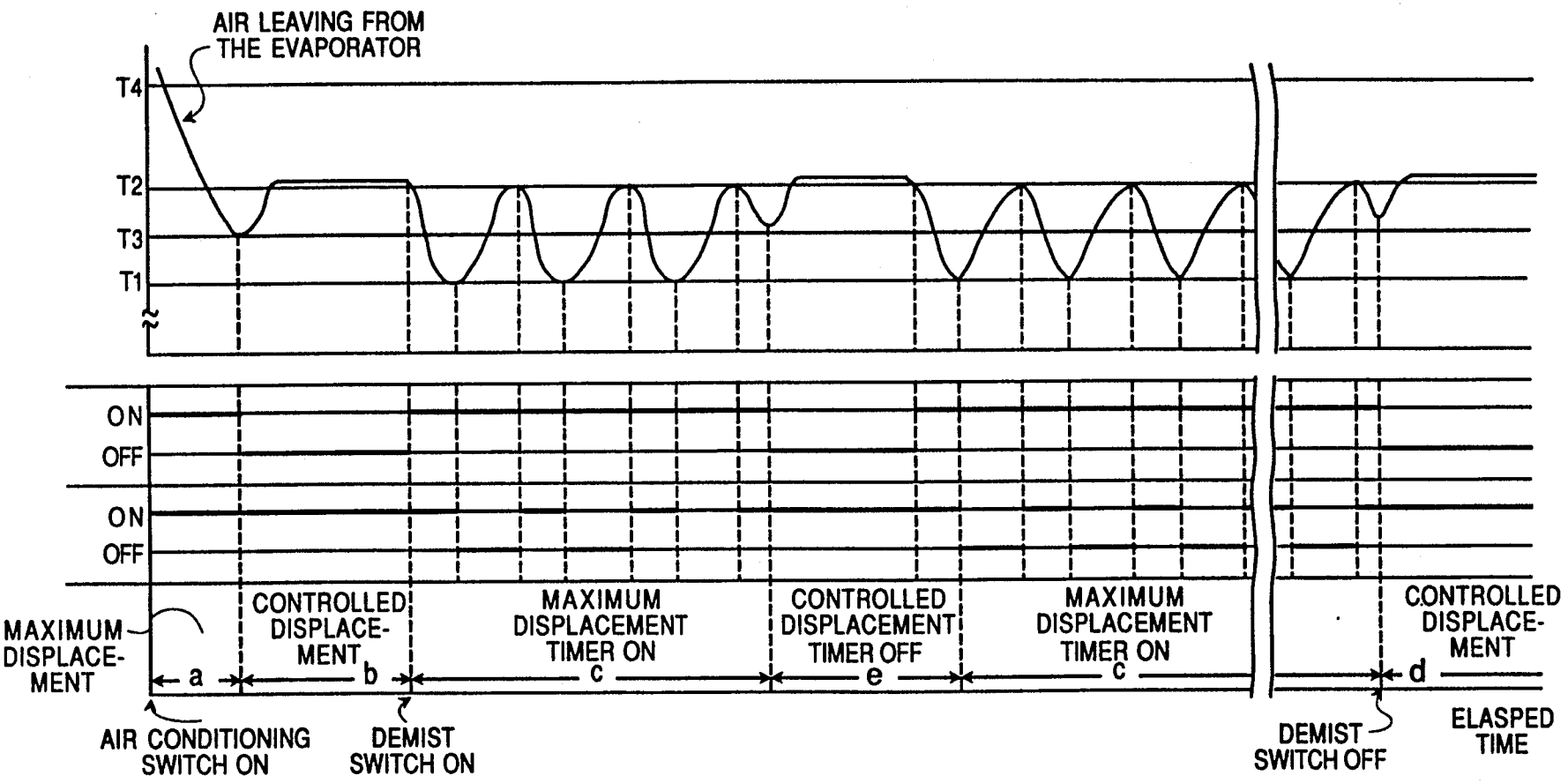
FIG. 11 is a graph of air temperature vs. elapsed time in an automobile air conditioning system according to the second embodiment of the invention.

The second embodiment of control apparatus 200 controls the temperature of the leaving air as shown in FIG. 11. When the automobile air conditioning switch is turned on without closing contact 221*a* of demist switch 221, and the temperature of the leaving air is higher than T4, the change in temperature of the leaving air is illustrated at time period "a". In time period "a", compressor 10 continuously operates with the maximum displacement. When temperature of the leaving air falls to T3, time period "a" is terminated, and time period "b" begins. In time period "b", compressor 10 starts to operate with controlled displacement by operation of only first valve control device 81 in order to maintain the temperature of the leaving air constant, for example, immediately above T2. In this period, when the visibility through the window shields of the automobile becomes poor, contact 221*a* of demist switch 221 is closed, and time period "b" is simultaneously terminated. After time period "b", the change in temperature of the leaving air is illustrated at time period "c". In time period "c", compressor 10 operates with maximum displacement again, but intermittently by virtue of the intermittent operation of electromagnetic clutch 90. Thereby, temperature of the leaving air is cyclically controlled from T2 to T1. When a predetermined time has elapsed from the start of time period "c", time period "c" is terminated, which simultaneously starts time period "e". In time period "e", compressor 10 operates with the controlled displacement by operation of only first valve control device 81 in order to maintain the temperature of the leaving air constant, for example, immediately above T2. When a predetermined time has elapsed from the start of time period "e", time period "e" is terminated, which simultaneously starts time period "c" again. These time periods "c" and "e" are alternately repeated in order to recover good visibility through the windows of the automobile. When good visibility through the windows of the automobile is recovered, contact 221*a* of demist switch 221 is opened, and the repetition of time periods "c" and "e" is simultaneously terminated. After time periods "c" and "e", the change in temperature of the leaving air in illustrated by time period "d". In time period "d", compressor 10 operates with the controlled displacement again, the same as during time period "b".

In the second embodiment, compressor 10 operates alternately with controlled displacement and maximum displacement in the demist so that energy consumption of the automobile engine is decreased in comparison with the first embodiment.

Figure 12:
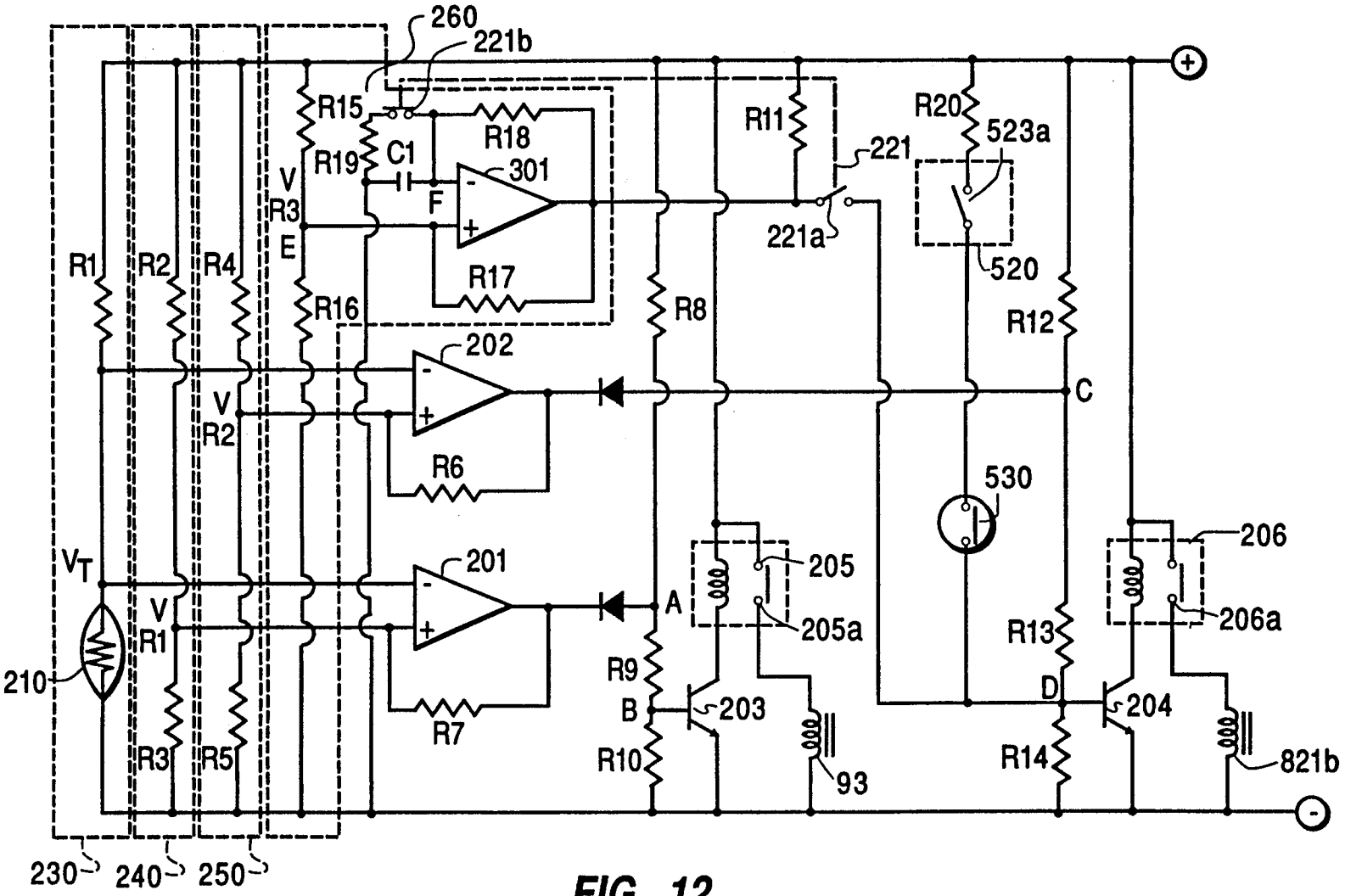
FIG. 12 in a circuit diagram of a third embodiment of the invention.

FIG. 12 illustrates a circuit diagram of a third embodiment of control apparatus 200. The circuit of the third embodiment is formed by providing first and second switching devices 520 and 530. They are connected in series with each other between the positive terminal of the power supply and connection point "D".

Figure 13:
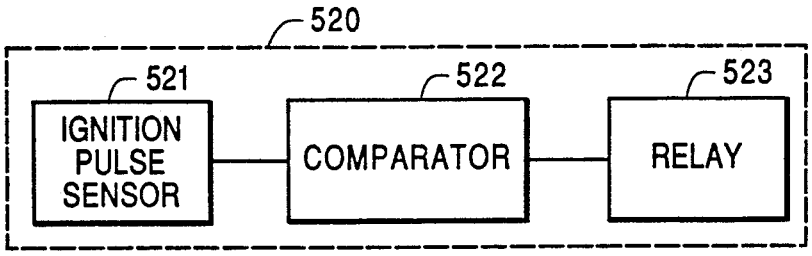
FIG. 13 is a block diagram of a control apparatus according to a third embodiment of the invention.
Figure 14:
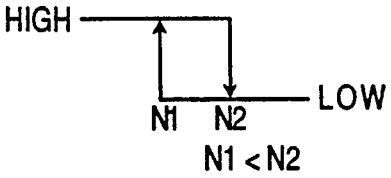
FIG. 14 is a graph illustrating the hysteresis effect of the first switching device shown in FIG. 12.

With reference to FIGS. 12 and 13, first switching device 520 includes ignition pulse sensor 521, comparator 522 and relay 523 having contact 523*a*. Ignition pulse sensor 521 detects ignition pulses to determine the rate of rotation of the automobile engine. Comparator 522 receives the signal representing rate of rotation and compares the signal with a predetermined value in order to generate a signal which controls relay 523. The input-output response of comparator 522 has a hysteresis. That is, as the rate rotation of the engine increases from a level lower than the rate at idling N1, the output does not change from high to low until the rate of rotation becomes higher than a rate of rotation, N2, which is higher than N1 by a certain number. However, as the rate of rotation decreases from a level higher than the rate of rotation N2, the output changes from low to high when the rate of rotation becomes equal to the rate of rotation at idling N1. As a result, output of comparator 522 has a hysteresis as shown in FIG. 14. When relay 523 receives the high level signal from comparator 522, contact 523*a* of relay 523 is closed. When relay 523 receives the low level signal from comparator 522, contact 523*a* of relay 523 is opened.

Figure 15:
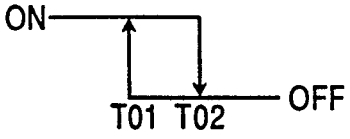
FIG. 15 is a graph view illustrating the hysteresis effect of the second switching device shown in FIG. 12.

Second switching device 530 turns on and off with a mechanical hysteresis in response to the temperature of air outside the automobile. That is, as the temperature of air outside the automobile increases from a level lower than a first predetermined temperature To1, second switching device 530 does not change from on to off until the temperature becomes higher than a second predetermined temperature, To2, which is higher than To1 by a certain amount. However, as the temperature of the air outside the automobile decreases from a level higher than the second predetermined temperature To2, second switching device 530 changes from off stage to on when the temperature becomes equal to the temperature To1. As a result, the on-off response of second switching device 530 has a hysteresis as shown in FIG. 15.

Figure 16:
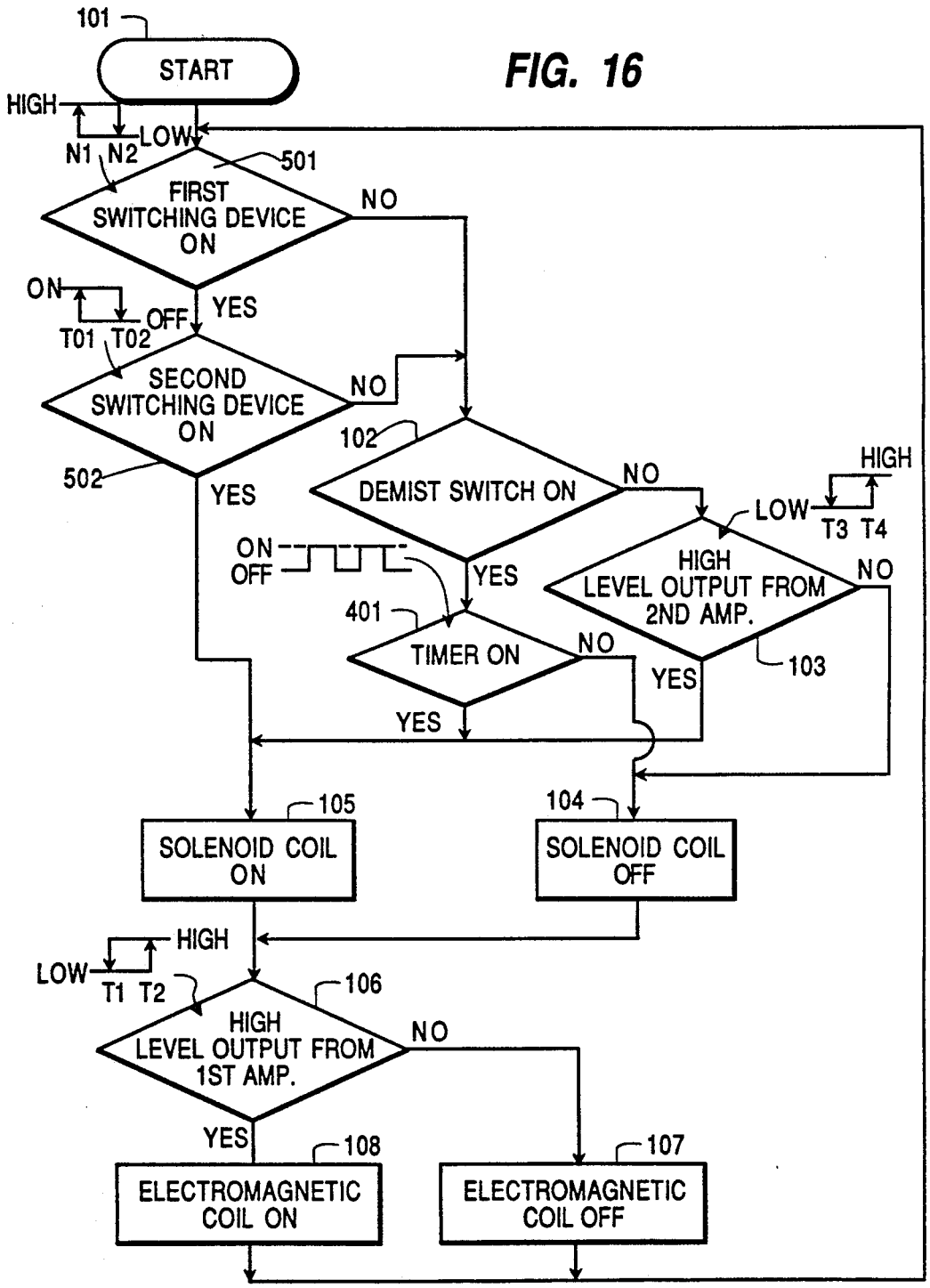
FIG. 16 in a flow chart illustrating the operation of the compressor according to the third embodiment of the invention.

FIG. 16 shows a flow chart of the third embodiment of control apparatus 200. As depicted in FIG. 16, the flow chart of the second embodiment shown in FIG. 10 can be changed to the flow chart of the third embodiment by adding stops 501 and 502 after step 101. In this embodiment, when either the first switching device 520 is high or the second switching device 530 is on, or when neither of the above are true, first and second switching devices 520 and 530 do not override demist switch 221. That is, the third embodiment of control apparatus 200 controls compressor 10 the same as the second embodiment of control apparatus 200.

On the other hand, when both the output of first switching device 520 is high and the second switching device 530 is on, first and second switching devices 520 and 530 override demist switch 221. Thereby, solenoid coil 821*b* remains energized and the compressor continues to operate at maximum displacement. Thus, an unnecessary increase in the rate of rotation of the engine during idling can be prevented, thereby reducing fuel consumption.

The temperature changes of the leaving air during operation of the automobile air conditioning system according to the third embodiment of control apparatus 200 is similar to the second embodiment. Therefore, no graph illustrating it is included.

The following switching device can be used as the demist switch in each embodiment of the invention. The switching device includes a lever formed in the air conditioning operation panel in the dash board. When the lever is positioned at the point marked "DEMIST" on the panel, the switch is turned on so as to energize solenoid coil 821*b*.

I claim:

1. In a refrigerating system including a refrigerant circuit formed by a condenser, expansion element, evaporator and compressor, said compressor including a variable displacement control mechanism, canceling means for canceling the operation of said variable displacement control mechanism, detecting means for detecting a thermal condition of said evaporator and generating a control signal, first control means for controlling the operation of said compressor in response to the control signal, and second control means for controlling the operation of said canceling means in response to the control signal, the improvement comprising:

selecting means for selectively enabling one of said second control means and said canceling means, said cancelling means operating without regard to the control signal when enabled by the selecting means.

2. The refrigerating system of claim 1 wherein said selecting means is a switching device.

3. The refrigerating system of claim 1 wherein the thermal condition of said evaporator is the temperature of air immediately leaving said evaporator.

4. The refrigerating system of claim 1 wherein said compressor is driven by an internal combustion engine of an automobile, and said selecting means enables said canceling means without regard to the control signal when both the number of rotations of the internal combustion engine is lower than a predetermined value and the temperature outside the automobile is lower than a predetermined value.

5. The refrigerating system of claim 1 wherein said detecting means comprises a thermistor.

6. The refrigerating system of claim 3 wherein said detecting means comprises a thermistor.

7. The refrigerating system of claim 1 wherein said detecting means includes means for sensing the temperature of air leaving the evaporator.

8. The refrigerating system of claim 7 wherein said sensing means comprises a thermistor.

9. A refrigerating system including a refrigerant circuit formed by a condenser, expansion element, evaporator and compressor, said refrigerating system comprising:

a variable displacement control mechanism included within said compressor;

canceling means for canceling the operation of said variable displacement control mechanism;

first detecting means for detecting a thermal condition of said evaporator and generating a control signal;

first control means for controlling the operation of said variable displacement control mechanism in response to the control signal;

second control means for controlling the operation of said canceling means in response to the control signal; and demist switch means for enabling either said second control means or said canceling means.

10. The refrigerating system of claim 9, said first detecting means comprising a thermistor.

11. The refrigerating system of claim 9, said compressor being driven by an internal combustion engine of an automobile, said refrigerating system further including second detecting means for detecting whether the rate of rotation of the internal combustion engine is below a predetermined value;

third detecting means for detecting whether the temperature outside the automobile is lower than a predetermined value; and selecting means selecting said canceling means when said second detecting means and said third detecting means indicate the presence of both their respective conditions.

12. A refrigerating system including a refrigerant circuit formed by a condenser, expansion element, evaporator and compressor, said refrigerating system comprising:

a variable displacement control mechanism included within said compressor canceling means for canceling the operation of said variable displacement control mechanism;

first detecting means for detecting a thermal condition of said evaporator and generating a control signal;

first control means for controlling the operation of said variable displacement control mechanism in response to the control signal;

second control means for controlling the operation of said canceling means in response to said control signal; and demisting means for overriding said second control means and activating said canceling means.

13. The refrigerating system of claim 12 wherein said demisting means comprises a switching device.

14. The refrigerating system of claim 12 wherein said first detecting means comprises a thermistor.

15. The refrigerating system of claim 12, said compressor being driven by an internal combustion engine of an automobile, said refrigerating system further including second detecting means for detecting whether the rate of rotation of the internal combustion engine is below a predetermined value;

third detecting means for detecting whether the temperature outside the automobile is lower than a predetermined value; and selecting means activating said canceling means when said second detecting means and said third detecting means indicate the presence of both their respective conditions.

16. A refrigerating system including a refrigerant circuit formed by a condenser, expansion element, evaporator and compressor, the compressor including a compressor housing having a central portion, a front plate at one end and a rear plate at its other end, said housing having a cylinder block, said cylinder block including a plurality of hollow cylinders, a piston slidably fitted within each of said cylinders, a drive mechanism coupled to said pistons to reciprocate said pistons within said cylinders, said drive mechanism including a drive shaft rotatably supported in said housing, said drive shaft coupled to rotational motion transmitting means for transmitting a rotational motion from a power source thereto, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and thus the capacity of said compressor, said rear plate having a suction chamber and a discharge chamber, variable displacement control means for controlling angular displacement of said adjustable member, said variable displacement control means including first and second valve control means, said second valve control means capable of overriding and canceling the effect of said first valve control means, a temperature control circuit including temperature detecting means for detecting the temperature of the air leaving the evaporator, said second valve control means responsive to said temperature control circuit, and switching means for overriding said temperature control circuit and activating said second valve control means.

17. The refrigerating system of claim 16, wherein said temperature control circuit further includes first reference signal source means for generating a predetermined reference signal equal to the output signal of said temperature detecting means corresponding to a predetermined first temperature, first comparing means for comparing the output from said first temperature detecting means with said first reference signal and providing an output at a first level when the detected temperature is higher than said first temperature and at a second level when the detected temperature is lower than said first temperature, first hysteresis means for causing the output of said first comparing means to display a hysteresis effect, first stop-signal generating means coupled with the output of said first comparing means for generating a first signal for stopping the operation of said second valve control means, and first stop-signal prohibiting means coupled with the output of said first stop-signal generating means and with the output of said temperature detecting means, said first stop-signal prohibiting means prohibiting said first stop signal from reaching said second valve control means until a time when a predetermined second temperature higher than said first temperature is detected by said temperature detecting means, said second valve control means coupled with the output of said first stop-signal prohibiting means to thereby stop the operation of said second valve control means during the time period when said first stop signal is present at the output of said first stop-signal prohibiting means.

18. The refrigerating system of claim 17 wherein said temperature control circuit further comprises second reference signal source means for generating a predetermined reference signal equal to the output signal of said temperature detecting means corresponding to a predetermined third temperature, second comparing means for comparing the output from said temperature detecting means with said second reference signal and providing an output at a third level when the detected temperature is higher than said third temperature and at a fourth level when the detected temperature is lower than said third temperature, second hysteresis means for causing the output of said second comparing means to display a hysteresis effect, second stop-signal generating means coupled with the output of said second comparing means for generating a second signal for stopping the operation of said rotational motion transmitting means, and second stop signal prohibiting means coupled with the output of said second stop-signal generating means and with the output of said temperature detecting means, said second stop-signal prohibiting means prohibiting said stop signal from stopping the operation of the rotational motion transmitting means until a time when a predetermined fourth temperature higher than said third temperature is detected by said temperature detecting means, said rotational motion transmitting means coupled with the output of said second stop-signal prohibiting means to thereby stop the operation of said rotational motion transmitting means during a time period when said second stop signal is present at the output of said second stop-signal prohibiting means.

19. The refrigerating system of claim 16 wherein said first valve control means comprising a first passageway providing fluid communication between said crank chamber and said suction chamber and first valve means controlling the opening and closing of said first passageway to vary the capacity of the compressor, said first valve means comprising a first valve to directly open and close said first passageway.

20. The refrigerating system of claim 19 wherein said second valve control means comprising a second passageway providing fluid communication between said crank chamber and said suction chamber and second valve means controlling the opening and closing of said second passageway to vary the capacity of said compressor, said second valve means comprising a second valve to directly open and close said second passageway and override the operation of said first valve.

21. The refrigerating system of claim 16 further comprising second detecting means for detecting whether the rate of rotation of the internal combustion engine is below a predetermined value, third detecting means for detecting whether the temperature outside the automobile is lower than a predetermined value, means for immediately activating said second valve means when the second and third detecting means indicate the presence of both their respective conditions.

* * * * *